US006646515B2

(12) United States Patent
Jun et al.

(10) Patent No.: US 6,646,515 B2
(45) Date of Patent: Nov. 11, 2003

(54) ISOLATOR/CIRCULATOR HAVING PROPELLER RESONATOR LOADED WITH A PLURALITY OF SYMMETRIC MAGNETIC WALLS

(75) Inventors: Dong-suk Jun, Daejon (KR); Sang-seok Lee, Daejon (KR); Tae-goo Choy, Daejon (KR)

(73) Assignees: Electronics and Telecommunications Research Institute, Daejon (KR); EG Co., Ltd., Chungcheongnam-do (KR)

( * ) Notice: Subject to any disclaimer, the term of this patent is extended or adjusted under 35 U.S.C. 154(b) by 0 days.

(21) Appl. No.: 10/075,825

(22) Filed: Feb. 12, 2002

(65) Prior Publication Data

US 2003/0112089 A1 Jun. 19, 2003

(30) Foreign Application Priority Data

Dec. 14, 2001 (KR) ..... 10-2001-79307

(51) Int. Cl.[7] ..... H01P 1/387
(52) U.S. Cl. ..... 333/1.1; 333/24.2
(58) Field of Search ..... 333/1.1, 24.2; H01P 1/387

(56) References Cited

U.S. PATENT DOCUMENTS

| | | | | | |
|---|---|---|---|---|---|
| 3,174,116 | A | * | 3/1965 | Sur | 333/1.1 |
| 3,304,519 | A | * | 2/1967 | Weiss | 333/1.1 |
| 4,390,853 | A | * | 6/1983 | Mathew et al. | 333/1.1 |
| 6,130,587 | A | * | 10/2000 | Jun et al. | 333/24.2 |
| 2002/0008595 | A1 | * | 1/2002 | Ohta et al. | 333/1.1 |

FOREIGN PATENT DOCUMENTS

| | | | | |
|---|---|---|---|---|
| JP | 06291516 | A | * 10/1994 | H01P/1/387 |
| JP | 10135711 | A | * 5/1998 | H01P/1/36 |

* cited by examiner

*Primary Examiner*—Robert Pascal
*Assistant Examiner*—Stephen E. Jones
(74) *Attorney, Agent, or Firm*—Blakely, Sokoloff, Taylor & Zafman

(57) ABSTRACT

A microstripline/stripline included in an isolator/circulator is provided. The microstripline/stripline includes a resonator including a plurality of symmetric propellers, which are capable of transmitting signals in a single direction, slot formation units formed between the propellers to allow magnetic walls to be symmetrically generated and each including a plurality of slots, transfer tracks for bandwidth expansion formed at a side of each of the propellers within the range of the distance (the circumscribed radius of the resonator) between the center of the resonator and the outermost edge of the propeller, and ports formed at the ends of the transfer tracks. The microstripline/stripline further includes a coupler for detecting a reverse signal formed at the port, to which a load resistor is connected, and an indicator for indicating the reverse signal detected by the coupler in order to detect the state of the isolator and a system including the isolator. Accordingly, it is possible to manufacture a microstripline/stripline isolator/circulator to have a low insertion loss, high isolation, a wide bandwidth, a compact size, a low price, a simple structure, and a light weight, and it is possible to observe the state of the microstripline/stripline isolator/circulator and a system including the microstripline/stripline isolator/circulator.

28 Claims, 8 Drawing Sheets

ISOLATOR/CIRCULATOR HAVING PROPELLER RESONATOR LOADED WITH A PLURALITY OF SYMMETRIC MAGNETIC WALLS

BACKGROUND OF THE INVENTION

1. Field of the Invention

The present invention relates to an isolator/circulator used for the components' protection and impedance matching of systems and terminals in mobile communication, personal communication, cordless telephones, and satellite communication, and more particularly, to a microstripline/stripline isolator/circulator having a propeller resonator.

2. Description of the Related Art

An isolator/circulator can operate in a predetermined direction, taking advantage of irreversibility of a permanent magnet and ferrite, and its frequency can be easily adjusted. A compact-sized isolator/circulator for terminals uses a microstripline, and a large-sized isolator/circulator uses a stripline. In recent years, the size of systems used for mobile communication, satellite communication, and millimeter waves has been reduced, and accordingly, it has been required to decrease the size, weight, and manufacturing costs of an isolator/circulator. In addition, the isolator/circulator has been required to have a low insertion loss, a high isolation, and a wide bandwidth.

FIG. 1 is a cross-sectional view of a conventional isolator/circulator including a stripline, and FIG. 2 is a cross-sectional view of a conventional isolator/circulator including a microstripline Referring to FIG. 1, a conventional isolator/circulator includes a stripline 104 interpolated between an upper ferrite substrate 102*a* and a lower ferrite substrate 102*b*. A ground electrode 107 is formed at the top surface of the upper ferrite substrate 102*a* and at the bottom surface of the lower ferrite substrate 102*b*. An upper permanent magnet 103*a* is formed on the upper ferrite substrate 102*a*, and a lower permanent magnet 103*b* is formed under the lower ferrite substrate 102*b*. A thin iron plate 108 is interpolated between the upper permanent magnet 103*a* and the ground electrode 107 and between the lower permanent magnet 103*b* and the ground electrode 107.

Referring to FIG. 2, a conventional isolator/circulator includes a microstripline 104 formed on a ferrite substrate 102. A ground electrode 107 is formed at the bottom surface of the ferrite substrate 102. An upper permanent magnet 103*a* is formed on the microstripline 104, and a lower permanent magnet 103*b* is formed under the ferrite substrate 102. A thin Teflon® film 109 is interpolated between the upper permanent magnet 103*a* and the microstripline 104, and a thin iron plate 108 is interpolated between the lower permanent magnet 103*b* and the ground electrode 107.

The microstripline/stripline 104 that may be included in the conventional isolator/circulators shown in FIGS. 1 and 2 will be described in greater detail with reference to FIG. 3. As shown in FIG. 3, a circular resonator 100, which resonates at a predetermined frequency, is formed at the center of the microstripline/stripline 104. A first electrode 105*a*, a second electrode 105*b*, and a third electrode 105*c* are symmetrically formed along the circumference of the circular resonator 100 to connect the circular resonator 100 to an external circuit via their respective transfer tracks 106*a*, 106*b*, and 106*c*. In the case of an isolator, a load resistance of 50 Ω (a load resistor having resistance of 50 Ω is connected to the third electrode 105*c*. Here, reference numerals 102 and 103 represent a ferrite substrate and an upper or lower permanent magnet, respectively.

In a circulator having the microstripline/stripline 104, a signal of the external circuit is transmitted counterclockwise from the first electrode 105*a* to the second electrode 105*b*, from the second electrode 105*b* to the third electrode 105*c*, and from the third electrode 105*c* to the first electrode 105*a*. Here, the signal of the external circuit may be set to be transmitted clockwise. Accordingly, signals are circularly input into/output from a plurality of ports of the circulator.

In an isolator having the microstripline/stripline 104, a signal of the external circuit is transmitted counterclockwise from the first electrode 105*a* to the second electrode 105*b* and from the second electrode 105*b* to the third electrode 105*c* and then is extinguished passing through the load resistor connected to the third electrode 105*c*. In other words, while the signal of the external circuit is transmitted from the first electrode 105*a* to the second electrode 105*b*, the signal of the external circuit is not transmitted from the second electrode 105*b* to the first electrode 105*a*. Thus, the signal input into the isolator can be transmitted in a forward direction without being diminished but cannot be transmitted in a reverse direction. The signal of the external circuit may be set to be transmitted in a clockwise direction, like in the circulator.

In the microstripline/stripline 104, the resonant frequency of the circular resonator 100 is inversely proportional to the size of the circular resonator 100. Thus, in order to obtain a higher resonant frequency from the circular resonator 100, the circular resonator 100 is designed to have a smaller size. However, there is a limit in reducing the size of the circular resonator 100 to be capable of being used for ultrahigh frequency (UHF) for mobile communication or personal communication, and thus it is difficult to manufacture a compact-sized isolator/circulator.

FIG. 4 is a pattern view of a conventional microstripline/stripline. Referring to FIG. 4, a circular resonator 200 is formed at the center of a microstripline/stripline 204, and three slots 207 are formed along the circumference of the circular resonator 200 toward the center of the circular resonator 200. Three ports including a first electrode 205*a*, a second electrode 205*b*, and a third electrode 205*c* are symmetrically formed along the circumference of the circular resonator 200 to connect the circular resonator 200 to an external circuit via their respective transfer tracks 206*a*, 206*b*, and 206*c*. Here, reference numerals 202 and 203 represent a ferrite substrate and an upper or lower permanent magnet, respectively.

In the microstripline/stripline 204, a magnetic wall is formed at the slots 207 so that magnetic coupling quantity can be controlled. Accordingly, it is possible to manufacture an isolator/circulator having the same resonant frequency as an isolator/circulator having the microstripline/stripline 104 shown in FIG. 3 but having a smaller size by appropriately adjusting the length of the slots 207. However, in this case, in order to expand bandwidth, a bandwidth expansion circuit must be connected to the isolator/circulator, and thus there is a limit in manufacturing the isolator/circulator to be compact-sized at lower manufacturing costs. In addition, since the magnetic wall formed at the circular resonator 200 is used, the size of the upper or lower permanent magnet 203 is greater than the size of the circular resonator 200. Accordingly, ferromagnetic resonance line width (AH), which corresponds to loss of a magnetic body and amounts to at least the size of the circular resonator 200, exists. Thus, there is a limit in decreasing insertion loss.

FIG. 5 is a pattern view of a conventional microstripline/stripline. Referring to FIG. 5, a triangular resonator 300 is formed at the center of a microstripline/stripline 304, and three slots 307 is formed at the central portion of each side of the triangular resonator 300 toward the center of the triangular resonator 300 in order to control magnetic coupling quantity. Open-ring-shaped transfer tracks 306*a*, 306*b*, and 306*c* are formed extending from the vertexes of the triangular resonator 300 toward the outside of the triangular resonator 300. Three ports including a first electrode 305*a*, a second electrode 305*b*, and a third electrode 305*c* are symmetrically formed to connect the transfer tracks 306*a*, 306*b*, and 306*c* to an external circuit. Here, reference numerals 302 and 303 represent a ferrite substrate and an upper or lower permanent magnet.

Magnetic coupling occurs at the transfer tracks 306*a*, 306*b*, and 306*c* and the slots 307 of the triangular resonator 300 Due to the magnetic coupling, it is possible to manufacture a compact-sized isolator/circulator. In addition, magnetic coupling occurs between the transfer tracks 306*a*, 306*b*, and 306*c* and the first, second, and third electrodes 305*a*, 305*b*, and 305*c* and between the transfer tracks 306*a*, 306*b*, and 306*c* and the triangular resonator 300. Thus, impedance matching can be performed well, and a process of manufacturing an isolator/circulator can be simplified. However, like in the microstripline/stripline 204, there is still a limit in reducing the size of an isolator/circulator and insertion loss because the microstripline/stripline 304 takes advantage of magnetic coupling.

Various researches have been vigorously carried out to develop a compact-sized isolator/circulator having a microstripline/stripline, which can be effectively used at UHF that is generally used for mobile communication or personal communication. For example, according to U.S. Pat. No. 5,608,361 and U.S. Pat. No. 6,130,587, it is possible to manufacture an isolator/circulator to have a compact size, a wide bandwidth, and a low insertion loss; However, it is impossible to detect the state of a system including such an isolator/circulator. Specifically, in U.S. Pat. No. 6,130,587, a method of assembling an isolator/circulator is suggested. However, the method is not appropriate for mass production of an isolator/circulator because elements of an isolator/circulator are required to be appropriately aligned with each other.

SUMMARY OF THE INVENTION

To solve the above-described problems, it is a first object of the present invention to provide an isolator/circulator having a microstripline/stripline, which can have a low insertion loss, high isolation, a wide bandwidth, a compact size, a low price, a simple structure, and a light weight by solving the problems with the prior art and improving the prior art.

It is a second object of the present invention to provide an isolator/circulator having a microstripline/stripline, which is capable of allowing its state and the state of a system including itself to be detected.

To achieve the above objects, there is provided an isolator/circulator having a microstripline/stripline. The isolator/circulator includes a resonator including a plurality of symmetric propellers, which are capable of transmitting signals in a single direction, slot formation units formed between the propellers to allow magnetic walls to be symmetrically generated and each including a plurality of slots, transfer tracks for bandwidth expansion formed at a side of each of the propellers within the range of the distance (the circumscribed radius of the resonator) between the center of the resonator and the outermost edge of the propeller, and ports formed at the ends of the transfer tracks. The isolator further includes a load resistor which is connected to any of a plurality of ports formed in the microstripline/stripline.

It is preferable that the isolator/circulator further includes a coupler for detecting a reverse signal formed at any one of the plurality of the ports, and an indicator for indicating the reverse signal detected by the coupler in order to detect the state of the isolator/circulator and a system including the isolator/circulator. In the case of the isolator, the coupler is installed in any one of the plurality of ports, to which the load resistor is connected, and the indicator is connected to the coupler.

The frequency of the resonator may be controlled by controlling the ratio of the sum of the length of each of the slots and the distance (the inscribed radius of the resonator) between the center of the resonator and the outermost edge of the slot formation units with respect to the circumscribed radius of the resonator. Magnetic coupling quantity can be controlled by modifying the width and length of each of the slots while maintaining the inscribed radius of the resonator 0.6 times greater than the circumscribed radius of the resonator. Thus, the isolator/circulator may be compact-sized with a low saturation magnetization value.

The isolator/circulator having a stripline may be assembled as follows. A stripline is interpolated between upper and lower ferrite substrates. An upper case for a ground electrode is located over the upper ferrite substrate and has through holes, into which a plurality of screws can be inserted, and upper permanent magnet installed therein. A lower case for the ground electrode is located under the lower ferrite substrate and has grooves, into which the plurality of screws can be fit, and a lower permanent magnet installed therein. The radius of the upper and lower permanent magnets is less than the circumscribed radius of the resonator and is no less than the inscribed radius of the resonator so that usage of ferrite can be reduced. It is preferable that the radius of the upper and lower permanent magnets is equal to the inscribed radius of the resonator. As a result, low insertion low characteristics can be realized. A step difference as much as the thickness of the upper and lower ferrite substrates and the stripline exists in the lower case so that the upper and lower cases can be fit into each other to be in gear with each other. A groove, in which the load resistor will be installed, is prepared in the lower case of the isolator. The upper and lower cover simultaneously covers the upper and lower sides of the upper and lower cases assembled together without the need of additional assembling screws.

A method of assembling the isolator/circulator having a microstripline may be realized as follows. A microstripline is prepared on the ferrite substrate. An upper case for a ground electrode is located over the ferrite substrate and has through holes, into which a plurality of screws can be inserted and an upper permanent magnet installed therein. A lower case for the ground electrode is located under the ferrite substrate and has grooves, into which the plurality of screws can be fit and a lower permanent magnet installed therein. An upper and lower cover is formed to protect a magnetic field. Side covers is formed to constitute a closed circuit. SMA connectors are formed to connect the microstripline to an external circuit. A step difference as much as the thickness of the ferrite substrate and the microstripline exists in the lower case so that the upper and lower cases can be fit into each other to be in gear with each other. A groove, in which the load resistor will be installed, is prepared in the lower case of the isolator. The upper and lower cover simultaneously covers the upper and lower sides of the upper and lower cases assembled together without the need of additional assembling screws.

Since the operational frequency of the isolator/circulator according to the present invention can be controlled by forming a plurality of symmetric magnetic walls while maintaining the size of a propeller resonator, the size of the isolator/circulator can be reduced. Since a magnet having a smaller size than a resonator is used, it is possible to reduce insertion loss by decreasing the area of ferrite influenced by a magnetic field. It is possible to improve VSWR and isolation characteristics of the isolator/circulator by modifying slot formation units formed along the edge of the propeller resonator. Since transfer tracks for bandwidth expansion are formed within the range of the distance between the center of the propeller resonator and the outermost edge of the propeller resonator, it is possible to manufacture the isolator/circulator to have a compact size and a wide bandwidth.

Since a coupler is installed at an input/output port in order to detect a reverse signal and an indicator is installed to indicate the reverse signal detected by the coupler, it is possible to detect the state of an isolator/circulator and a system including the isolator/circulator by inserting a circuit for detecting a reverse signal or a reflection signal into the isolator/circulator. Also, it is easy to assemble the isolator/circulator and thus the isolator/circulator can be mass-produced at low costs.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
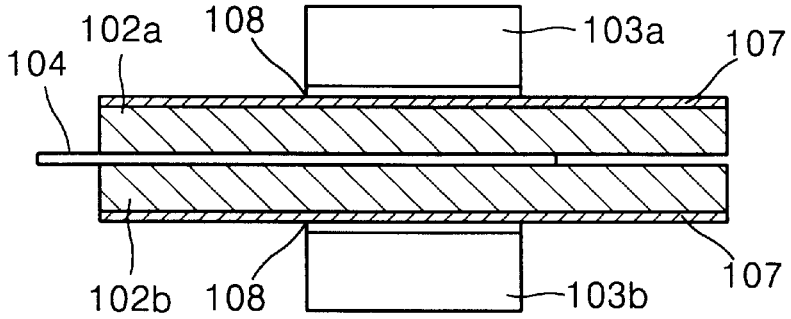
FIG. 1 (PRIOR ART)
FIG. 1 is a cross-sectional view of a conventional isolator/circulator having a stripline.
Figure 2:
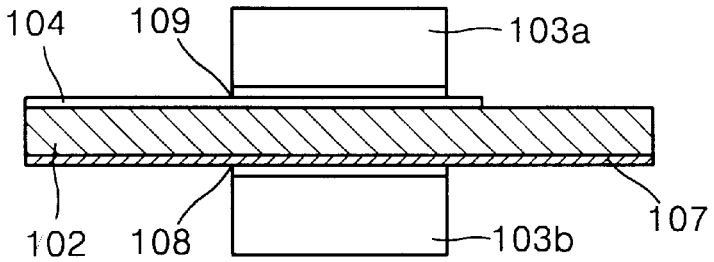
FIG. 2 (PRIOR ART)
FIG. 2 is a cross-sectional view of a conventional isolator/circulator having a microstripline.
Figure 3:
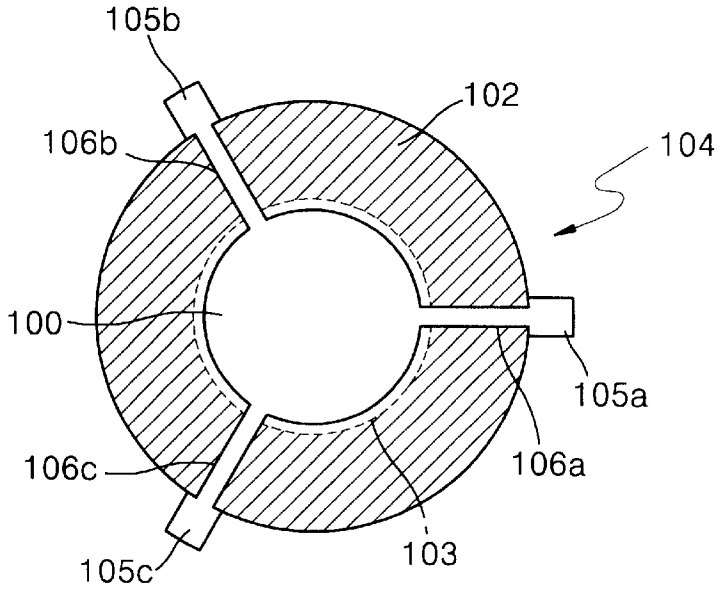
FIG. 3 (PRIOR ART)
FIG. 3 is a view illustrating the pattern of a conventional microstripline/stripline that may be included in the isolator/circulators shown in FIGS. 1 and 2.
Figure 4:
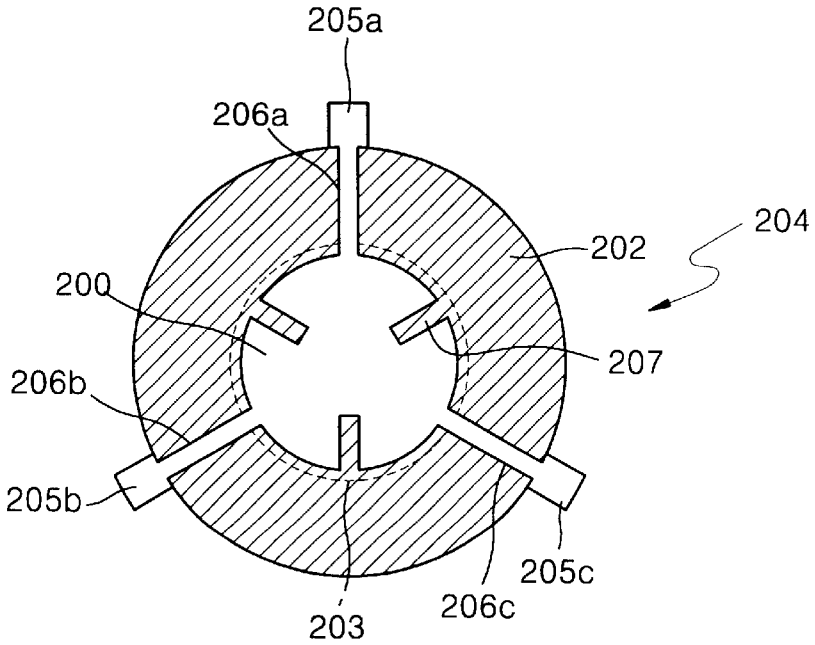
FIG. 4 (PRIOR ART)
FIG. 4 is a view illustrating the pattern of another conventional microstripline/stripline.
Figure 5:
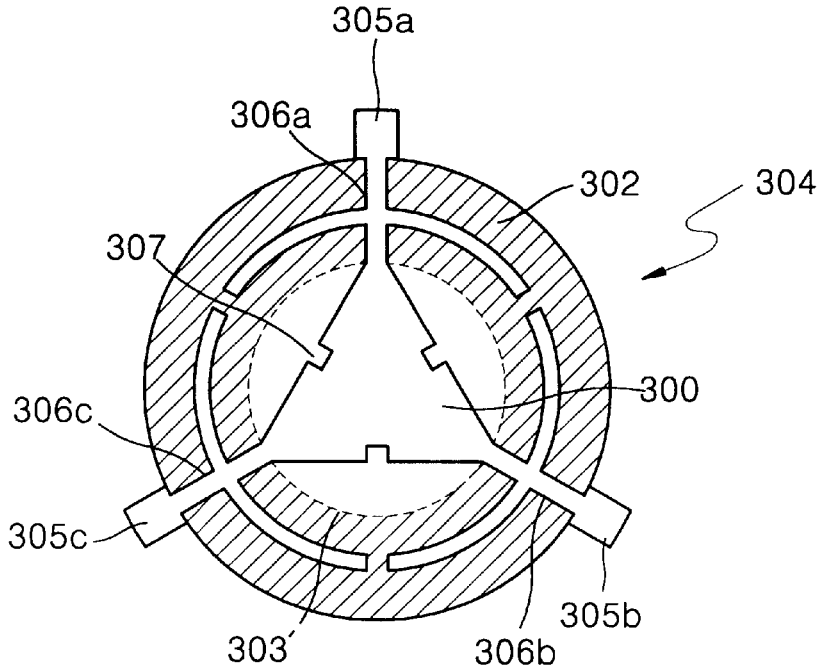
FIG. 5 (PRIOR ART)
FIG. 5 is a view illustrating the pattern of another conventional microstripline/stripline.

The present invention will now be described more fully with reference to the accompanying drawings, in which preferred embodiments of the invention are shown. This invention may, however, be embodied in many different forms and should not be construed as being limited to the embodiment set forth herein. Rather, this embodiment is provided so that this disclosure will be thorough and complete, and will convey the concept of the invention to those skilled in the art. The same reference numerals in different drawings represent the same elements. Various elements and regions are schematically illustrated in the drawings. The present invention is not restricted to their size or thickness.

Figure 6:
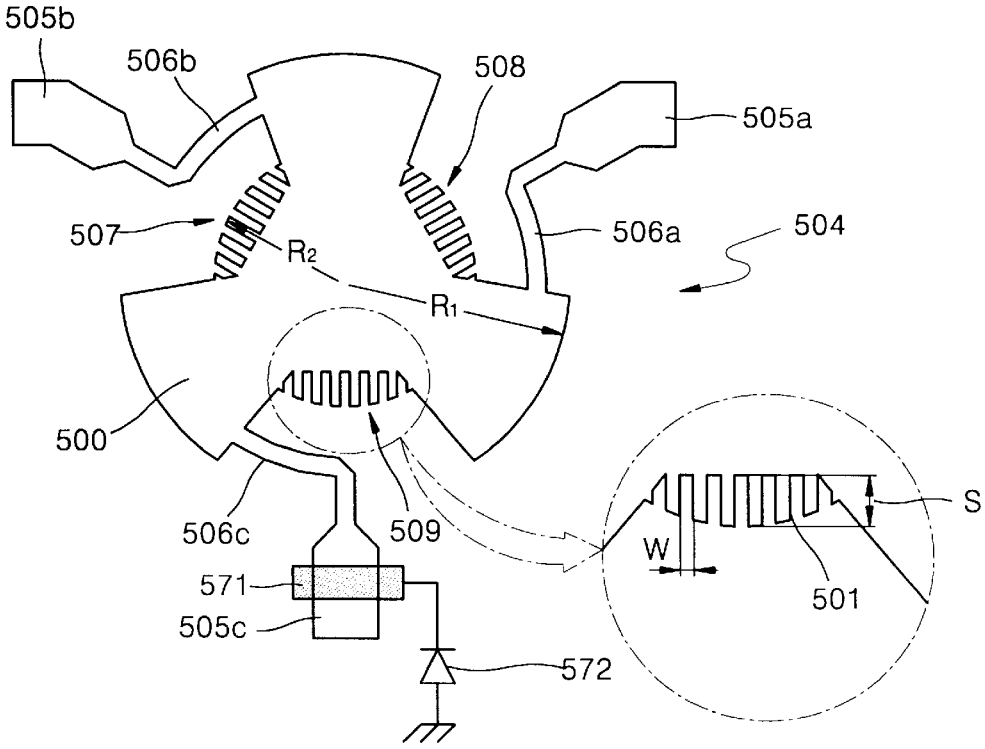
FIG. 6 is a view illustrating the pattern of a microstripline/stripline according to a preferred embodiment of the present invention.

FIG. 6 is a view illustrating the pattern of a microstripline/stripline of an isolator/circulator according to a preferred embodiment of the present invention. Referring to FIG. 6, a microstripline/stripline 504 includes a resonator 500, which has three symmetric propellers so that a signal can be transmitted in only one direction, slot formation units 507, 508, and 509, in which a plurality of slots 501 are formed among the three symmetric propellers, transfer tracks 506*a*, 506*b*, and 506*c* for bandwidth expansion, which is formed at one side of each of the three propellers within the range of the circumscribed radius $R_1$ (the distance between the center of the resonator 500 and the outermost end of each of the propellers) of the resonator 500, and first, second, and third electrodes 505*a*, 505*b*, and 505*c* formed at the ends of the transfer tracks 506*a*, 506*b*, and 506*c*, respectively, to serve as ports. The first through third electrodes 505*a*, 505*b*, and 505*c* may have different forms from one another for convenience of assembling. An isolator further includes a load resistor (not shown), which is connected to any of the first through third electrodes 505*a*, 505*b*, and 505*c*, for example, the third electrode 505*c*, as shown in FIG. 6.

Here, a coupler 571 is installed at any of the first through third electrodes 550*a*, 550*b*, and 550*c*, for example, at the third electrode 550*c* so that the state of the isolator/circulator and a system including the isolator/circulator can be detected and a reverse signal can be detected. Preferably, the microstripline/stripline 504 further includes an indicator 572 for indicating a reverse signal detected by the coupler 571, such as a light-emitting diode (LED). In an isolator, the coupler 571 is installed at an electrode, to which a load resistor is connected, and the indicator 572 is connected to the coupler 571.

The basic mode of the resonator 500 is formed to be low, and the electrical characteristics of the resonator 500, such as frequency, can be easily controlled due to a plurality of magnetic walls generated by the slot formation units 507, 508, and 509. Accordingly, it is possible to reduce the size of the resonator 500. The frequency of an isolator/circulator having the microstripline/stripline 504 can be controlled by controlling the ratio of the sum of the length (S) of a slot 501 and the distance between the center of the resonator 500 and the outermost end of each of the slot formation units 507, 508, and 509 (the inscribed radius $R_2$ of the resonator 500) with respect to the circumscribed radius $R_1$ of the resonator 500. In other words, the frequency (f) of the resonator 500 can be controlled according to Equation (1).

$$f^{-1} = A \cdot \frac{S + R_2}{R_1} \quad (1)$$

In Equation (1), A is a constant. According to Equation (1), as $$\frac{S + R_2}{R_1}$$

increases, the frequency (f) of the resonator 500 decreases. On the other hand, as $$\frac{S + R_2}{R_1}$$

decreases, the frequency (f) of the resonator 500 increases. Accordingly, the size of the resonator 500 can be reduced by controlling the value of $$\frac{S + R_2}{R_1}.$$

Magnetic coupling quantity can be easily controlled by modifying the width (W) and length (S) of the slot 501 while maintaining the inscribed radius $R_2$ of the resonator 500 to be 0.6 times greater than the circumscribed radius $R_1$ of the resonator 500. Accordingly, it is possible to manufacture a compact-sized isolator/circulator with a low saturation magnetization value and improve the voltage standing wave ratio (VSWR) and isolation characteristics of the isolator/circulator.

In order to reduce insertion loss, the radius of upper and lower permanent magnets is less than the circumscribed radius $R_1$ of the resonator 500 and is no less than the inscribed radius $R_2$ of the resonator 500. The radius of the upper and lower permanent magnets is preferably the same as the inscribed radius $R_2$ of the resonator 500. Accordingly, usage of ferrite can be reduced, and thus it is possible to manufacture an isolator/circulator having a low insertion loss.

The transfer tracks 506*a*, 506*b*, and 506*c*, which are capable of controlling bandwidth, is set to have a length of $\lambda/4$ at a desired resonant frequency. Since the transfer tracks 506*a*, 506*b*, and 506*c* are formed within the range of the circumscribed radius $R_1$ of the resonator 500, it is possible to manufacture an isolator to have a compact size, a simple structure, a light weight and improved characteristics including VSWR and insertion loss.

As described above, the symmetric propeller resonator 500 having the slot formation units 507, 508, and 509 is capable of controlling frequency and bandwidth. In addition, since the symmetric propeller resonator 500 uses a small-sized magnet, it is possible to minimize the influence of irregular magnetic field of the magnet, there is no need to take measures to form regular magnetic field, and it is possible to minimize the influence of an external circuit. In addition, since it is possible to reduce the influence of ferromagnetic resonance line width ($\Delta H$), which corresponds to loss of a magnetic body that may occur when using the magnetic body, signals can be transmitted better. In other words, it is possible to manufacture an isolator/circulator having low insertion loss characteristics by reducing usage of ferrite.

Figure 7:
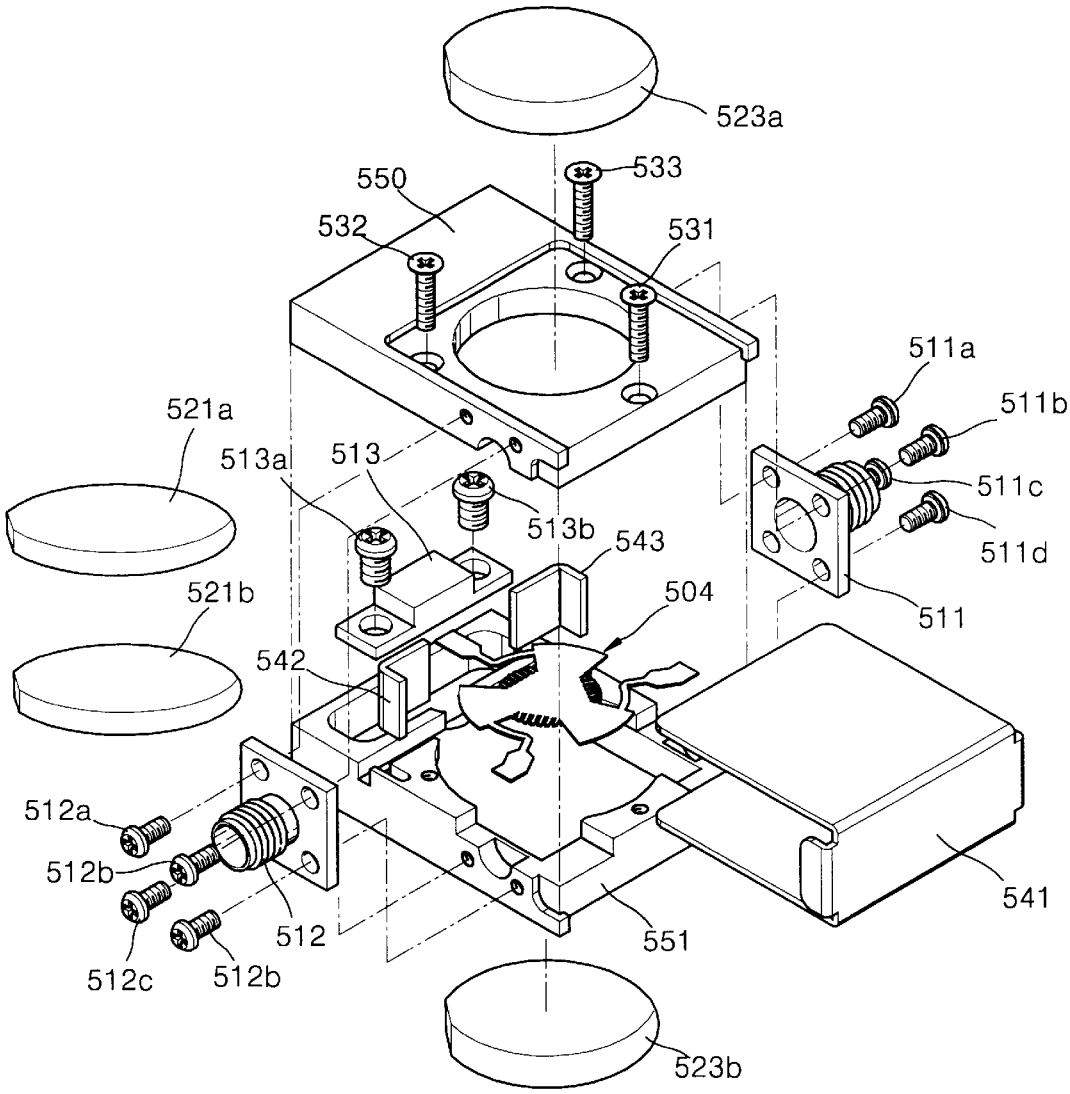
FIG. 7 is an exploded perspective view of an isolator having the stripline shown in FIG. 6.

FIG. 7 is an exploded perspective view of an isolator having the stripline 504 shown in FIG. 6. Referring to FIG. 7, an isolator having the stripline 504 includes an upper ferrite substrate 521*a* and a lower ferrite substrate 521*b*. The stripline 504 is interpolated between the upper ferrite substrate 521*a* and the lower ferrite substrate 521*b*. An upper case 550 for a ground electrode, at which through holes are formed so that a plurality of screws, for example, three screws 531, 532, and 533 can penetrate the upper case 550 through the holes, is located over the upper ferrite substrate 521*a*, and an upper permanent magnet 523*a* is installed in the upper case 550. A lower case 551 for a ground electrode, at which grooves are formed so that the screws 531, 532, and 533 can be fit into the grooves and thus can be fixed to the lower case 551, is located under the lower ferrite substrate 521*b*, and a lower permanent magnet 523*b* is installed in the lower case 551. The isolator includes an upper and lower cover 541 for protecting a magnetic field and side covers 542 and 543 for constituting a closed circuit. Reference numerals 511 and 512 represent SMA connectors for connecting the stripline 504 to an external circuit, and reference numeral 513 represents a load resistor. Reference numerals 511*a* through 511*d*, 512*a* through 512*d*, 513*a*, and 513*b* represent screws for connecting the SMA connectors 511 and 512 and the load resistor 513 to their respective ports of the stripline 504. A coupler (not shown) and an indicator (not shown) are connected to the port, to which the load resistor 513 is connected, from the outside of the upper and lower cases 550 and 551. The radius of the upper and lower permanent magnets 523*a* and 523*b* is less than the circumscribed radius of the resonator 500 and is no less than the inscribed radius of the resonator 500.

In the lower case 551, a step difference as much as the thickness of the upper and lower ferrite substrates 521*a* and 521*b* and the stripline 504 exists so that the lower case 551 and the upper case 550 can be assembled to be in gear with each other. A groove, in which the load resistor 513 can be installed, is prepared in the lower case 551. Accordingly, the elements of the isolator can be assembled together without the need of an additional alignment process. Therefore, it becomes easier to assemble the isolator and it is possible to manufacture the isolator to have regular characteristics.

The upper and lower cover 541 is formed to cover and fix the upper and lower cases 550 and 551 fit into each other at the same time without the need of additional assembling screws in order to protect a magnetic field. The upper and lower cover 541 can field block a magnetic field, and thus it is possible to allow a magnetic field to be regularly distributed around the isolator and to stably expand bandwidth.

Figure 8:
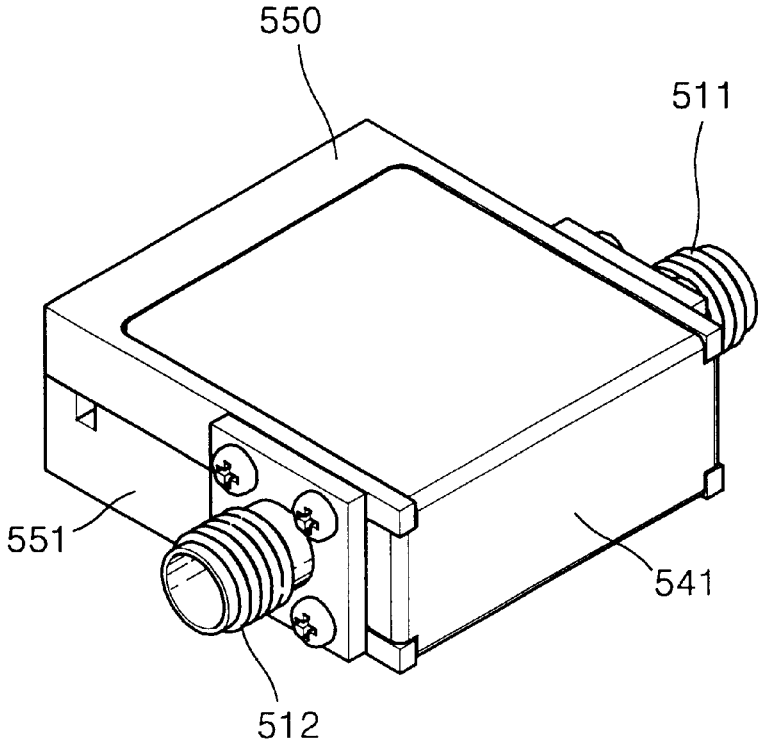
FIG. 8 is a view illustrating the assembled shape of the isolator shown in FIG. 7.

FIG. 8 is a view illustrating the assembled shape of the isolator shown in FIG. 7. As shown in FIG. 8, the isolator having the stripline 504 according to the present invention has a very compact structure, is easy to assemble, and thus is appropriate for mass production.

Figure 9:
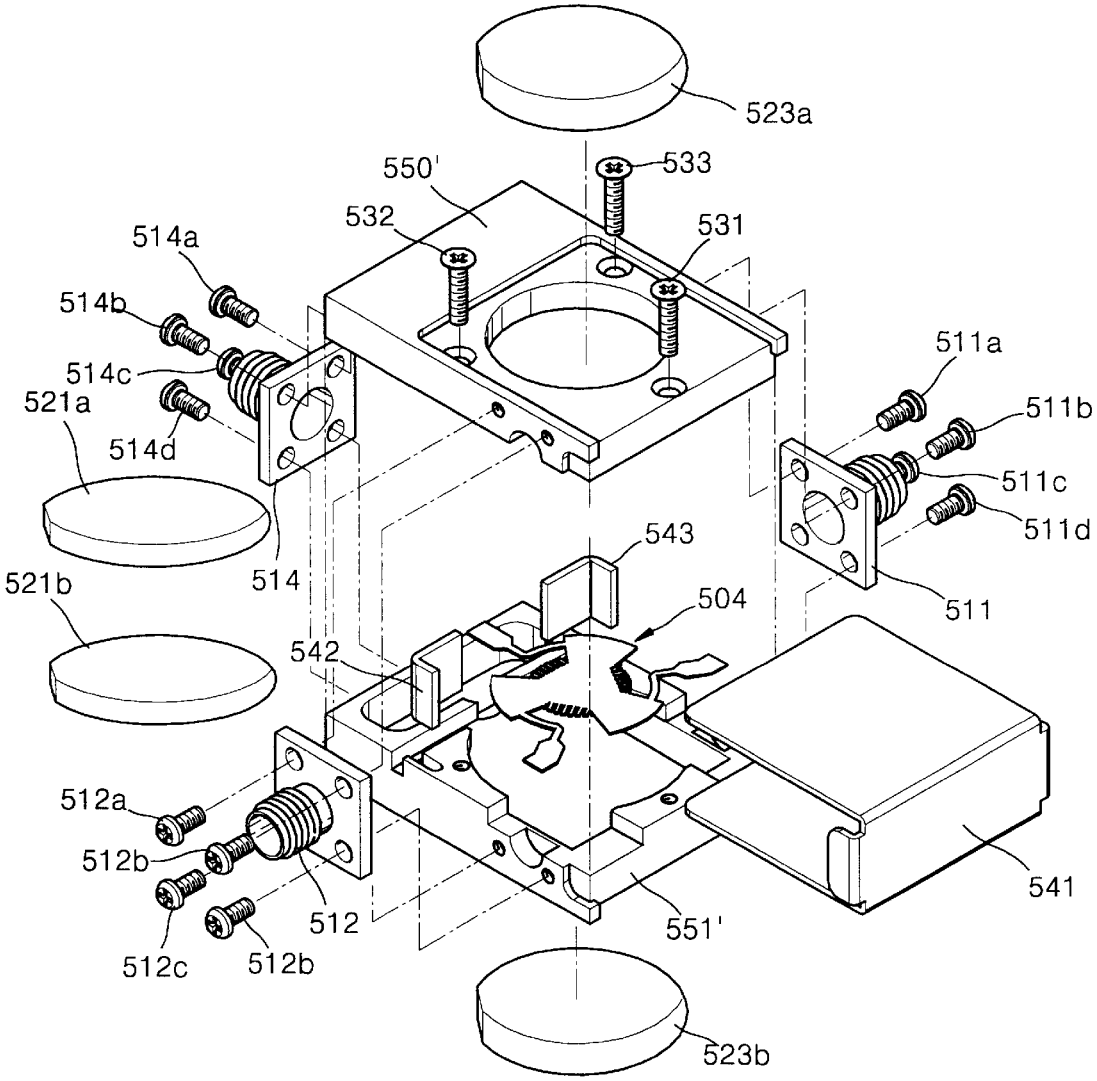
FIG. 9 is an exploded perspective view of a circulator having the stripline shown in FIG. 6.
Figure 10:
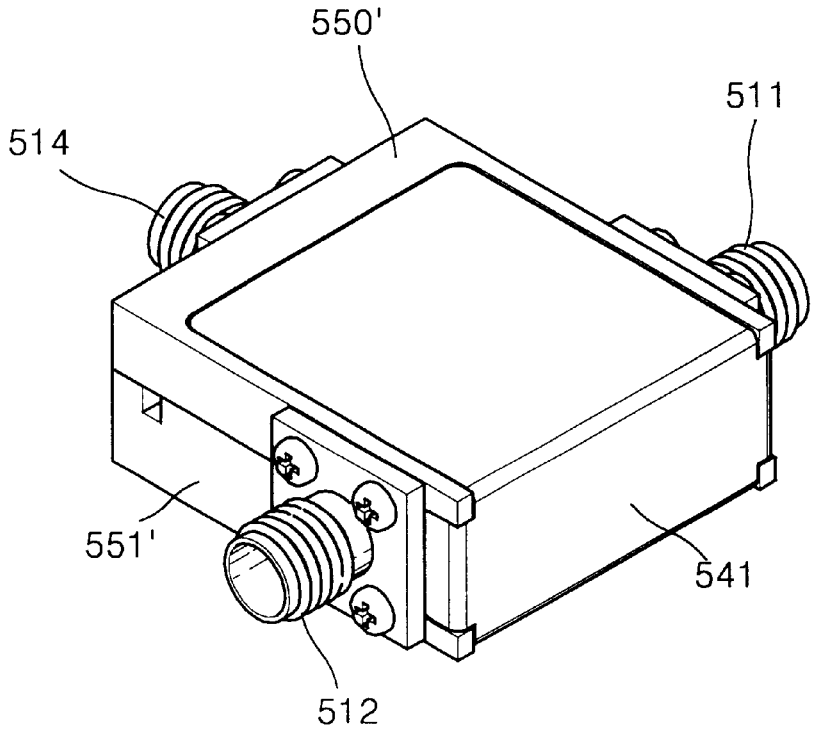
FIG. 10 is a view illustrating the assembled shape of the circulator shown in FIG. 9.

FIG. 9 is an exploded perspective view of a circulator having the stripline shown in FIG. 6, and FIG. 10 is a view illustrating the assembled shape of the circulator shown in FIG. 9. The same reference numerals in FIGS. 7 through 10 represent the same elements. Reference numerals 550' and 551' represent an upper case and a lower case, respectively.

As shown in FIGS. 7 and 9, a stripline circulator according to the present invention has almost the same structure as the stripline isolator according to the present invention. However, in the stripline circulator, a SMA connector 514 is installed at the same position as the load resistor 513 of the isolator shown in FIG. 7. Accordingly, there is no need to form a groove, in which the load resistor 513 will be installed, in the lower case 551'.

An isolator/circulator having a microstripline according to an embodiment of the present invention, like the isolator/circulator having a stripline according to the present invention, can be manufactured to have a compact size and an easily-assembled structure.

As described above, since a symmetric propeller resonator having a plurality of slots, which is easy to manufacture, is used in the present invention, it is possible to manufacture a compact-sized isolator/circulator at lower manufacturing costs. The characteristics of the isolator/circulator according to the present invention are very good even in consideration of the price of the isolator/circulator. In addition, the isolator/circulator according to the present invention is appropriate for mass production so that the manufacturing costs can be reduced.

While this invention has been particularly shown and described with reference to preferred embodiments thereof, it will be understood by those skilled in the art that various changes in form and details may be made therein without departing from the spirit and scope of the invention as defined by the appended claims. For example, the number of propellers (ports) formed in the isolator/circulator according to the present invention is not restricted to the numerical value set forth herein, and thus the isolator/circulator according to the present invention may be formed to have 4 or 5 propellers.

Since the operational frequency of the isolator/circulator according to the present invention can be controlled by forming a plurality of symmetric magnetic walls while maintaining the size of a propeller resonator, the size of the isolator/circulator can be reduced. It is possible to improve VSWR and isolation characteristics of the isolator/circulator by modifying slot formation units formed along the edge of the propeller resonator. Since transfer tracks for bandwidth expansion are formed within the range of the distance between the center of the propeller resonator and the outermost edge of the propeller resonator, it is possible to manufacture the isolator/circulator to have a compact size and a wide bandwidth.

Since a magnet having a smaller size than a resonator is used in the present invention, it is possible to reduce insertion loss by decreasing the area of ferrite influenced by a magnetic field. In addition, since it is possible to minimize the influence of an irregular magnetic field of the magnet, there is no need to take measures to regularly form a magnetic field, and it is possible to minimize the influence of an external circuit.

Since a coupler is installed at an input/output port in order to detect a reverse signal and an indicator is installed to indicate the reverse signal detected by the coupler, it is possible to detect the state of an isolator/circulator and a system including the isolator/circulator by inserting a circuit for detecting a reverse signal or a reflection signal into the isolator/circulator.

Since upper and lower cases and an upper and lower cover are used in the present invention, the manufacture of an isolator/circulator is very simple, and thus the manufacturing costs can be reduced.

Accordingly, the microstripline/stripline isolator/circulator according to the present invention has a low insertion loss, high isolation, a wide bandwidth, a compact size, a low price, a simple structure, and a light weight, can detect reverse signals, and can be used for protection and impedance matching of a system and a terminal In mobile communication, personal communication, CT, and satellite communication.

What is claimed is:

1. An isolator having a microstripline/stripline comprising:

a resonator including a plurality of symmetric propellers, which are capable of transmitting signals in a single direction;

slot formation units formed between the propellers to allow magnetic walls to be symmetrically generated and each including a plurality of slots, said plurality of slots vary in size;

transfer tracks for bandwidth expansion formed at a side of each of the propellers within the range of the distance (the circumscribed radius of the resonator) between the center of the resonator and the outermost edge of the propeller; and ports formed at the ends of the transfer tracks.

2. The isolator of claim 1 further comprising a coupler for detecting a reverse signal formed at the port, to which a load resistor is connected, and an indicator for indicating the reverse signal detected by the coupler in order to detect the state of the isolator and a system including the isolator.

3. The isolator of claim 1, wherein the frequency of the resonator can be controlled by controlling the ratio of the sum of the length of each of the slots and the distance (the inscribed radius of the resonator) between the center of the resonator and the outermost edge of the slot formation units with respect to the circumscribed radius of the resonator.

4. The isolator of claim 1, wherein magnetic coupling quantity can be controlled by modifying the width and length of each of the slots while maintaining the inscribed radius of the resonator 0.6 times greater than the circumscribed radius of the resonator.

5. A circulator having a microstripline/Stripline comprising:

a resonator including a plurality of symmetric propellers, which are capable of transmitting signals in a single direction;

slot formation units formed between the propellers to allow magnetic walls to be symmetrically generated and each including a plurality of slots, said plurality of slots vary in size;

transfer tracks for bandwidth expansion formed at a side of each of the propellers within the range of the distance (the circumscribed radius of the resonator) between the center of the resonator and the outermost edge of the propeller; and ports formed at the ends of the transfer tracks.

6. The circulator of claim 5 further comprising a coupler for detecting a reverse signal formed at any of the ports, and an indicator for indicating the reverse signal detected by the coupler in order to detect the state of the circulator and a system including the circulator.

7. The circulator of claim 5, wherein the frequency of the resonator can be controlled by controlling the ratio of the sum of the length of each of the slots and the distance (the inscribed radius of the resonator) between the center of the resonator and the outermost edge of the slot formation units with respect to the circumscribed radius of the resonator.

8. The circulator of claim 5, wherein magnetic coupling quantity can be controlled by modifying the width and length of each of the slots while maintaining the inscribed radius of the resonator 0.6 times greater than the circumscribed radius of the resonator.

9. A stripline isolator comprising:

an upper ferrite substrate;

a lower ferrite substrate;

a stripline interpolated between the upper and lower ferrite substrates;

an upper case for a ground electrode located over the upper ferrite substrate and having through holes, into which a plurality of screws can be inserted, the upper case, in which an upper permanent magnet is installed;

a lower case for the ground electrode located under the lower ferrite substrate and having grooves, into which the plurality of screws can be fit, the lower case, in which a lower permanent magnet is installed;

an upper and lower cover for protecting a magnetic field;

side covers for constituting a closed circuit;

SMA connectors for connecting the stripline to an external circuit; and a load resistor, wherein the stripline comprises a resonator including a plurality of symmetric propellers, which are capable of transmitting signals in a single direction, slot formation units formed between the propellers to allow magnetic walls to be symmetrically generated and each including a plurality of slots, said plurality of slots vary in size, transfer tracks for bandwidth expansion formed at a side of each of the propellers within the range of the distance (the circumscribed radius of the resonator) between the center of the resonator and the outermost edge of the propeller, and ports formed at the ends of the transfer tracks, a step difference as much as the thickness of the upper and lower ferrite substrates and the stripline exists in the lower case so that the upper and lower cases can be fit into each other to be in gear with each other, a groove, in which the load resistor will be installed, is prepared in the lower case, and the upper and lower cover simultaneously covers the upper and lower sides of the upper and lower cases assembled together without the need of additional assembling screws.

10. The stripline isolator of claim 9 further comprising a coupler for detecting a reverse signal formed at the port, to which the load resistor is connected, and an indicator for indicating the reverse signal detected by the coupler in order to detect the state of the stripline isolator and a system including the stripline isolator.

11. The stripline isolator of claim 9, wherein the frequency of the resonator can be controlled by controlling the ratio of the sum of the length of each of the slots and the distance (the inscribed radius of the resonator) between the center of the resonator and the outermost edge of the slot formation units with respect to the circumscribed radius of the resonator.

12. The stripline isolator of claim 11, wherein the radius of the upper and lower permanent magnets is less than the circumscribed radius of the resonator and is no less than the inscribed radius of the resonator.

13. The stripline isolator of claim 9, wherein magnetic coupling quantity can be controlled by modifying the width and length of each of the slots while maintaining the inscribed radius of the resonator 0.6 times greater than the circumscribed radius of the resonator.

14. A stripline circulator comprising:

an upper ferrite substrate;

a lower ferrite substrate;

a stripline interpolated between the upper and lower ferrite substrates;

an upper case for a ground electrode located over the upper ferrite substrate and having through holes, into which a plurality of screws can be inserted, the upper case, in which an upper permanent magnet is installed;

a lower case for the ground electrode located under the lower ferrite substrate and having grooves, into which the plurality of screws can be fit, the lower case, in which a lower permanent magnet is installed;

an upper and lower cover for protecting a magnetic field;

side covers for constituting a closed circuit; and

SMA connectors for connecting the stripline to an external circuit, wherein the stripline comprises a resonator including a plurality of symmetric propellers, which are capable of transmitting signals in a single direction, slot formation units formed between the propellers to allow magnetic walls to be symmetrically generated and each including a plurality of slots, said plurality of slots vary in size, transfer tracks for bandwidth expansion formed at a side of each of the propellers within the range of the distance (the circumscribed radius of the resonator) between the center of the resonator and the outermost edge of the propeller, and ports formed at the ends of the transfer tracks, a step difference as much as the thickness of the upper and lower ferrite substrates and the stripline exists in the lower case so that the upper and lower cases can be fit into each other to be in gear with each other, and the upper and lower cover simultaneously covers the upper and lower sides of the upper and lower cases assembled together without the need of additional assembling screws.

15. The stripline circulator of claim 14, further comprising a coupler for detecting a reverse signal formed at any of the ports and an indicator for indicating the reverse signal detected by the coupler in order to detect the state of the stripline circulator and a system including the stripline circulator.

16. The stripline circulator of claim 14, wherein the frequency of the resonator can be controlled by controlling the ratio of the sum of the length of each of the slots and the distance (the inscribed radius of the resonator) between the center of the resonator and the outermost edge of the slot formation units with respect to the circumscribed radius of the resonator.

17. The stripline circulator of claim 16, wherein the radius of the upper and lower permanent magnets is less than the circumscribed radius of the resonator and is no less than the inscribed radius of the resonator.

18. The stripline circulator of claim 14, wherein magnetic coupling quantity can be controlled by modifying the width and length of each of the slots while maintaining the inscribed radius of the resonator 0.6 times greater than the circumscribed radius of the resonator.

19. A microstripline isolator comprising:

a ferrite substrate;

a microstripline prepared on the ferrite substrate;

an upper case for a ground electrode located over the ferrite substrate and having through holes, into which a plurality of screws can be inserted, the upper case, in which an upper permanent magnet is installed;

a lower case for the ground electrode located under the ferrite substrate and having grooves, into which the plurality of screws can be fit, the lower case, in which a lower permanent magnet is installed;

an upper and lower cover for protecting a magnetic field;

side covers for constituting a closed circuit;

SMA connectors for connecting the microstripline to an external circuit; and a load resistor, wherein the microstripline comprises a resonator including a plurality of symmetric propellers, which are capable of transmitting signals in a single direction, slot formation units formed between the propellers to allow magnetic walls to be symmetrically generated and each including a plurality of slots, said plurality of slots vary in size, transfer tracks for bandwidth expansion formed at a side of each of the propellers within the range of the distance (the circumscribed radius of the resonator) between the center of the resonator and the outermost edge of the propeller, and ports formed at the ends of the transfer tracks, a step difference as much as the thickness of the ferrite substrate and the microstripline exists in the lower case so that the upper and lower cases can be fit into each other to be in gear with each other, a groove, in which the load resistor will be installed, is prepared in the lower case, and the upper and lower cover simultaneously covers the upper and lower sides of the upper and lower cases assembled together without the need of additional assembling screws.

20. The microstripline isolator of claim 19 further comprising a coupler for detecting a reverse signal formed at the port, to which the load resistor is connected, and an indicator for indicating the reverse signal detected by the coupler in order to detect the state of the microstripline isolator and a system including the microstripline isolator.

21. The microstripline isolator of claim 19, wherein the frequency of the resonator can be controlled by controlling the ratio of the sum of the length of each of the slots and the distance (the inscribed radius of the resonator) between the center of the resonator and the outermost edge of the slot formation units with respect to the circumscribed radius of the resonator.

22. The microstripline isolator of claim 21, wherein the radius of the upper and lower permanent magnets is less than the circumscribed radius of the resonator and is no less than the inscribed radius of the resonator.

23. The microstripline isolator of claim 19, wherein magnetic coupling quantity can be controlled by modifying the width and length of each of the slots while maintaining the inscribed radius of the resonator 0.6 times greater than the circumscribed radius of the resonator.

24. A microstripline circulator comprising:

a ferrite substrate;

a microstripline prepared on the ferrite substrate;

an upper case for a ground electrode located over the ferrite substrate and having through holes, into which a plurality of screws can be inserted, the upper case, in which an upper permanent magnet is installed;

a lower case for the ground electrode located under the ferrite substrate and having grooves, into which the plurality of screws can be fit, the lower case, in which a lower permanent magnet is installed;

an upper and lower cover for protecting a magnetic field;

side covers for constituting a closed circuit; and

SMA connectors for connecting the microstripline to an external circuit;

wherein the microstripline comprises a resonator including a plurality of symmetric propellers, which are capable of transmitting signals in a single direction, slot formation units formed between the propellers to allow magnetic walls to be symmetrically generated and each including a plurality of slots, said plurality of slots vary in size, transfer tracks for bandwidth expansion formed at a side of each of the propellers within the range of the distance (the circumscribed radius of the resonator) between the center of the resonator and the outermost edge of the propeller, and ports formed at the ends of the transfer tracks, a step difference as much as the thickness of the ferrite substrate and the microstripline exists in the lower case so that the upper and lower cases can be fit into each other to be in gear with each other, and the upper and lower cover simultaneously covers the upper and lower sides of the upper and lower cases assembled together without the need of additional assembling screws.

25. The microstripline circulator of claim 24 further comprising a coupler for detecting a reverse signal formed at any of the ports and an indicator for indicating the reverse signal detected by the coupler in order to detect the state of the microstripline circulator and a system including the microstripline circulator.

26. The microstripline circulator of claim 24, wherein the frequency of the resonator can be controlled by controlling the ratio of the sum of the length of each of the slots and the distance (the inscribed radius of the resonator) between the center of the resonator and the outermost edge of the slot formation units with respect to the circumscribed radius of the resonator.

27. The microstripline circulator of claim 26, wherein the radius of the upper and lower permanent magnets is less than the circumscribed radius of the resonator and is no less than the inscribed radius of the resonator.

28. The microstripline circulator of claim 24, wherein magnetic coupling quantity can be controlled by modifying the width and length of each of the slots while maintaining the inscribed radius of the resonator 0.6 times greater than the circumscribed radius of the resonator.

* * * * *